US007527346B2

(12) United States Patent
Izuchi

(10) Patent No.: US 7,527,346 B2
(45) Date of Patent: May 5, 2009

(54) INK-JET RECORDING APPARATUS

(75) Inventor: Masatoshi Izuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 212 days.

(21) Appl. No.: 11/462,248

(22) Filed: Aug. 3, 2006

(65) Prior Publication Data

US 2007/0030299 A1 Feb. 8, 2007

(30) Foreign Application Priority Data

Aug. 4, 2005 (JP) ..... 2005-226356

(51) Int. Cl.
*B41J 29/38* (2006.01)

(52) U.S. Cl. ..... 347/16

(58) Field of Classification Search ..... 347/16, 347/101, 104–105; 271/291; 355/24
See application file for complete search history.

(56) References Cited

U.S. PATENT DOCUMENTS

2004/0207708 A1 10/2004 Ohashi et al.
2005/0253886 A1* 11/2005 Nakajima et al. ..... 347/16

FOREIGN PATENT DOCUMENTS

JP 2002067407 A * 3/2002
JP 2004 224057 8/2004
JP 2004 331400 11/2004

OTHER PUBLICATIONS

Machine translation of JP 2002-067407 A.*

* cited by examiner

*Primary Examiner*—Matthew Luu
*Assistant Examiner*—Justin Seo
(74) *Attorney, Agent, or Firm*—Baker Botts LLP

(57) ABSTRACT

An ink-jet recording apparatus including an ink-jet recording head; two upstream-side rollers which feed a recording sheet to the head in a downstream direction along a sheet-feed path; two downstream-side rollers which feed the sheet from the head; at least one rotating device which rotates, in a forward direction corresponding to the downward direction, the upstream-side and downstream-side rollers, and rotates, in a backward direction corresponding to an upstream direction opposite to the downward direction, at least the downstream-side rollers; a sheet reversing device which reverses the sheet and feeds the reversed sheet to the upstream-side rollers; and a control device which controls, when the head records an image on one surface of the sheet, the rotating device to rotate, in the forward direction, the upstream-side and downstream-side rollers such that a trailing end of the sheet is fed to a position outside a radius range between (a) a nip position where the upstream-side rollers nip the sheet and (b) a downstream-side position distant from the nip position in the downstream direction by a distance equal to a radius of one of the upstream-side rollers that is located on one side of the sheet-feed path on which the recording head is provided, and which subsequently controls the rotating device to rotate, in the backward direction, the downstream-side rollers to feed the sheet in the upstream direction along the sheet-feed path so that the trailing end of the sheet enters the radius range within a first predetermined time duration.

22 Claims, 7 Drawing Sheets

INK-JET RECORDING APPARATUS

The present application is based on Japanese Patent Application No. 2005-226356 filed on Aug. 4, 2005, the contents of which are incorporated herein by reference.

BACKGROUND OF THE INVENTION

1. Field of the Invention

The present invention relates to an ink-jet recording apparatus, and particularly to such an ink-jet recording apparatus that can record an image on each of opposite sides or surfaces of a recording sheet.

2. Discussion of Related Art

There is known an ink-jet recording device including a sheet feeder that feeds a recording sheet; and an ink-jet recording head that ejects droplets of ink toward the recording sheet, so as to record a desirable image on the recording sheet. The sheet feeder includes a pair of upstream-side rollers that are provided on an upstream side of the recording head along a sheet-feed path and that nip the recording sheet and, when the upstream-side rollers are rotated in a forward direction, the recording sheet is fed in a downstream direction along the sheet-feed path. The sheet feeder additionally includes a pair of downstream-side rollers that are provided on a downstream side of the recording head along the sheet-feed path. After an image has been recorded on the recording sheet, the recording sheet is nipped by the downstream-side rollers and, when the downstream-side rollers are rotated in the forward direction, the recording sheet is discharged out of the ink-jet recording device.

There is also known such an ink-jet recording device that can record an image on each of opposite sides or surfaces of a recording sheet. More specifically described, first, when a recording sheet is fed in a downward direction by rotation of a pair of upstream-side rollers in a forward direction, an image is recorded on one surface of the recording sheet by an ink-jet recording head. After the recording of image on the one surface of the recording sheet ends, the pair of upstream-side rollers are rotated in a backward direction so as to feed the recording sheet in an upstream direction. Then, the recording sheet is reversed upside down by a sheet reversing device. Subsequently, when the recording sheet is fed again in the forward direction, another image is recorded on the other surface of the recording sheet. In particular, in a so-called "no-margin" printing mode in which no margins are left on a recording sheet, droplets of ink are ejected onto the recording sheet, up to a trailing end thereof. Therefore, at a timing when the recording of image on one surface of the recording sheet ends, the recording sheet is nipped by only a pair of downstream-side rollers because the trailing end thereof has been passed through, or released from, the pair of upstream-side rollers.

Meanwhile, at a timing immediately after the recording of image on one surface of the recording sheet ends, the ink droplets ejected onto the trailing-end portion of the recording sheet have not dried up. Therefore, if the recording sheet is fed in the upstream direction and is nipped by the pair of upstream-side rollers, the ink may be adhered to the upper one of the two upstream-side rollers, or the image recorded on the upper surface of the recording sheet may be distorted. To solve these problems, Japanese Patent Application Publication No. 2004-331400 or its corresponding U.S. Patent Application Publication No. 2004-207708A discloses an ink-jet recording device employing a separating means that separates two upstream-side rollers from each other when a recording sheet is fed in an upstream direction, and Japanese Patent Application Publication No. 2004-224057 discloses an ink-jet recording device employing a stopping means for temporarily stopping a recording sheet for a pre-determined time duration in which ink droplets ejected onto a recording sheet can dry up.

SUMMARY OF THE INVENTION

However, generally, the separating means that separates the two upstream-side rollers from each other when the recording sheet is fed in the upstream direction, needs to have a complicated arrangement, which leads to increasing the production cost of the ink-jet recording device.

In addition, it is generally known that after ink droplets are ejected onto a recording sheet, a phenomenon of "cockling" occurs as the ink droplets dry up. Cockling is such a phenomenon that as ink droplets ejected onto a recording sheet dry up, the recording sheet deforms and ripples. When the recording sheet is fed upstream for being reversed upside down, the above-indicated trailing end of the sheet enters a space left between the two upstream-side rollers. If the upstream feeding of the recording sheet is stopped for the pre-determined time duration in which the ink droplets ejected onto the trailing-end portion of the sheet dry up, then the cockling phenomenon occurs to the trailing-end portion of the sheet. And, if the trailing-end portion of the recording sheet to which the cockling phenomenon has occurred is introduced into the space left between the two upstream-side rollers, then the trailing-end portion of the sheet may not be nipped by the two rollers, i.e., jamming of the sheet may occur.

It is therefore an object of the present invention to solve at least one of the above-indicated problems. It is another object of the present invention to provide an ink-jet recording apparatus that can quickly record an image with a high quality on each of opposite surfaces of a recording sheet, while effectively preventing occurrence of jamming of the recording sheet.

The above objects may be achieved according to the present invention. According to a first aspect of the present invention, there is provided an ink-jet recording apparatus, comprising an ink-jet recording head which ejects droplets of ink toward one of opposite surfaces of a recording sheet so as to record a first image on the one surface; a pair of upstream-side rollers which are provided on an upstream side of the recording head with respect to a sheet-feed path and which are rotated to feed the recording sheet to the recording head in a downstream direction along the sheet-feed path; a pair of downstream-side rollers which are provided on a downstream side of the recording head with respect to the sheet-feed path and which are rotated to feed the recording sheet from the recording head in the downstream direction along the sheet-feed path; at least one rotating device which rotates, in a forward direction corresponding to the downward direction, the pair of upstream-side rollers and the pair of downstream-side rollers, and rotates, in a backward direction corresponding to an upstream direction opposite to the downward direction, at least the pair of downstream-side rollers; a sheet reversing device which reverses, on an opposite side of the pair of upstream-side rollers that is opposite to the recording head, the recording sheet having the first image on the one surface thereof, and which feeds the reversed recording sheet to the pair of upstream-side rollers so that the pair of upstream-side rollers feed the reversed recording sheet to the recording head again so as to record a second image on an other of the opposite surfaces of the reversed recording sheet; and a control device which controls, when the recording head records the first image on the one surface of the recording sheet, the at least one rotating device to rotate, in the forward direction, the pair of upstream-side rollers and the pair of downstream-side rollers such that a trailing end of the recording sheet is fed to a position outside a radius range between (a) a nip position where the pair of upstream-side rollers nip the recording sheet and (b) a downstream-side position that is distant from the nip position in the downstream direction by a distance equal to a radius of one of the pair of upstream-side rollers that is located on one side of the sheet-feed path on which side the recording head is provided, and which subsequently controls the at least one rotating device to rotate, in the backward direction, the pair of downstream-side rollers to feed the recording sheet in the upstream direction along the sheet-feed path so that the trailing end of the recording sheet enters the radius range within a first predetermined time duration.

In the present ink-jet recording apparatus, the ink-jet recording head first records an image on one surface of the recording sheet being fed downward along the sheet-feed path. Then, the recording sheet is fed upstream, is reversed upside down by the sheet reversing device, and is returned to the sheet-feed path. Subsequently, the recording head records an image on the other surface of the recording sheet being fed downward along the sheet-feed path by the pair of upstream-side rollers.

At the time when the recording of image on one surface of the recording sheet ends, the trailing end of the sheet is positioned on a downstream side of the radius range between the nip position where the two upstream-side rollers contact each other and the downstream-side position distant downstream from the nip position by the distance equal to the radius of one of the two upstream-side rollers. The radius range may be referred to as the jamming prevention range. Then, the recording sheet is fed upstream along the sheet-feed path so that within the first pre-determined time duration, the above-indicated trailing end of the sheet may enter the jamming prevention range. The first pre-determined time duration may be a time duration in which the droplets of ink(s) ejected onto the trailing-end portion of the recording sheet dry up. The trailing end of the recording sheet may be detected by a sheet-end detector during an image recording operation. The sheet-end detector may be arranged to produce a sheet-end detection signal when the detector detects an end of a recording sheet.

It is generally known that after droplets of ink are ejected onto a recording sheet, a cockling phenomenon that the recording sheet deforms and ripples occurs as the ink droplets dry up. However, in the present ink-jet recording apparatus, the trailing end of the recording sheet enters the jamming prevention range within the first pre-determined time duration. Therefore, after the trailing end of the recording sheet enters the jamming prevention range, the drying-up of the ink droplets and the occurrence of the cockling phenomenon ends or completes. Thus, when the recording sheet is fed upstream to the nip position, the trailing end of the sheet is normally nipped by the two upstream-side rollers, without causing jamming of the sheet. Since the ink droplets have dried up when the trailing end of the recording sheet is nipped by the two rollers, undesirable running of the ink can be prevented.

According to the present invention, the trailing end of the recording sheet can be positioned in the specific range in which the occurrence of jamming of the sheet is prevented, before the cockling phenomenon as one of the major causes of the jamming occurs. Therefore, even in double-side and no-margin printing modes in which an image is recorded on each of opposite surfaces of a recording sheet up to a trailing end of the each surface, the occurrence of jamming of the sheet can be effectively prevented. In addition, since the occurrence of jamming is prevented by controlling the feeding of the recording sheet, the construction of the ink-jet recording apparatus need not be complicated or the production cost of the same need not be increased.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described a preferred embodiment of the present invention by reference to the drawings.

Figure 1:
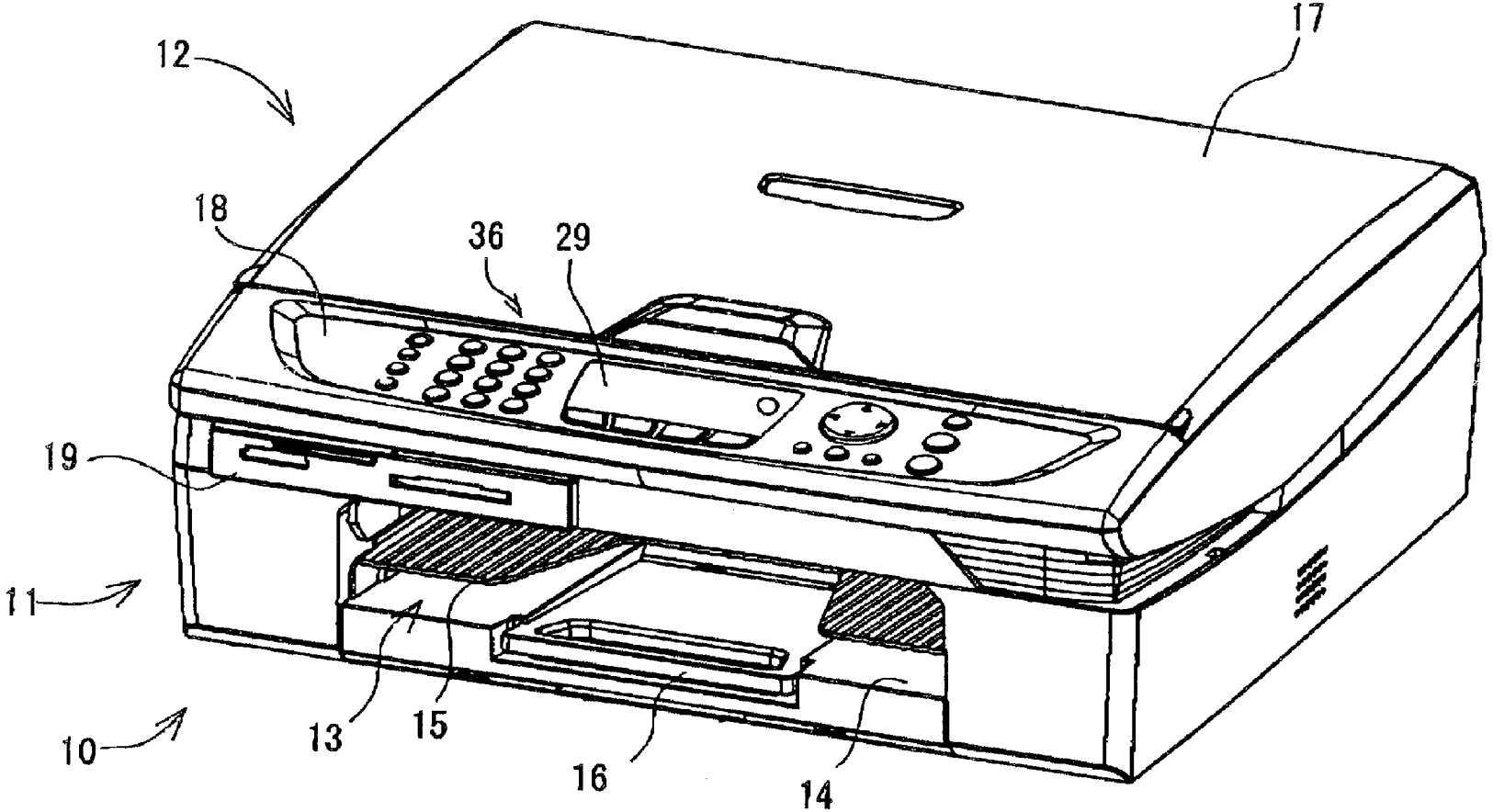
FIG. 1 is a perspective external view of a multi-function device (MFD) including an ink-jet recording apparatus to which the present invention is applied.

FIG. 1 shows a multi-function device (MFD) 10 to which the present invention is applied. The MFD 10 includes, in a lower portion thereof, a printer portion 11 and a communication portion, not shown, and additionally includes, in an upper portion thereof, a scanner portion 12. The MFD 10 has a printer function, a scanner function, a copier function, and a facsimile-machine function. In the present embodiment, the printer portion 11 is constituted by an ink-jet recording apparatus. Thus, the MFD 10 enjoys a small size. However, the MFD 10 may employ a plurality of sheet-supply cassettes and/or an automatic document feeder (ADF). The MFD 10 can be connected to a personal computer (PC) 38 (FIG. 4), and can record, based on image data (e.g., document data) sent from the PC 38, images (e.g., documents) on recording sheets. The MFD 10 may be connected to a digital camera, and may record, based on image data supplied from the digital camera, images on recording sheets. In addition, the MFD 10 includes a slot portion 19 that can receive various sorts of memories such as a flash memory, and the MFD 10 can record, based on image data read from each memory via the slot portion 19, images on recording sheets.

As shown in FIG. 1, the MFD 10 has an outer shape like a thin and elongate rectangular parallelepiped, that is, a length and a width of the MFD 10 are greater than a height thereof. The MFD 10 has, in a front surface thereof, an opening 13. A sheet-supply tray 14 and a sheet-discharge tray 15 can be inserted into the opening 13, such that the two trays 14, 15 are aligned with each other in a vertical direction. The sheet-supply tray 14 is for accommodating recording sheets, and can accommodate various sizes of recording sheets not larger than A-4 Size; such as A-4 Size, B-5 Size, or Postcard Size.

The sheet-supply tray 14 includes a slide portion 16 that can be drawn out, as needed, to increase an area of a bottom surface of the tray 14. As will be described later, each of the recording sheets accommodated by the sheet-supply tray 14 is supplied to the printer portion 11, so that appropriate images are recorded thereon. Each recording sheet on which images have been recorded is discharged onto the sheet-discharge tray 15.

The scanner portion 12 is constituted by a so-called "flat-bed" scanner. The MFD 10 includes a document cover 17 that can be opened and closed and functions as a top plate. Under the document cover 17, there are provided a platen glass and an image scanner, not shown. The platen glass is for supporting an original document placed thereon. The image scanner is provided below the platen glass, and is moved in a lengthwise direction of the MFD 10 so as to scan the original document.

The MFD 10 has, in a front and upper portion thereof, an operation panel 18. The operation panel 18 is manually operable by a user, for operating the printer portion 11 and/or the scanner portion 12, or receiving image data from a data memory (e.g., a flash memory) or a digital camera. A control device 31 (FIG. 3) that is provided in the lower portion of the MFD 10 controls the respective operations of the printer portion 11 and the scanner portion 12, and controls the operation of the MFD 10 as a whole. The control device 31 includes the above-indicated communication portion, as will be described later.

The MFD 10 operates according to commands inputted through the manual operation of the operation panel 18, or commands sent from a printer driver of the PC 38. The operation panel 18 includes various operation buttons 36 and a liquid crystal panel or display (LCD) 29. Various printing modes of the printer portion 11 can be set or selected through operation of the buttons 36. Those printing modes include a single-side or double-side printing mode, a margin-leaving or no-margin printing mode, a printing resolution, and a recording-sheet size (e.g., A-4 Size, B-5 Size, or Postcard Size).

Figure 3:
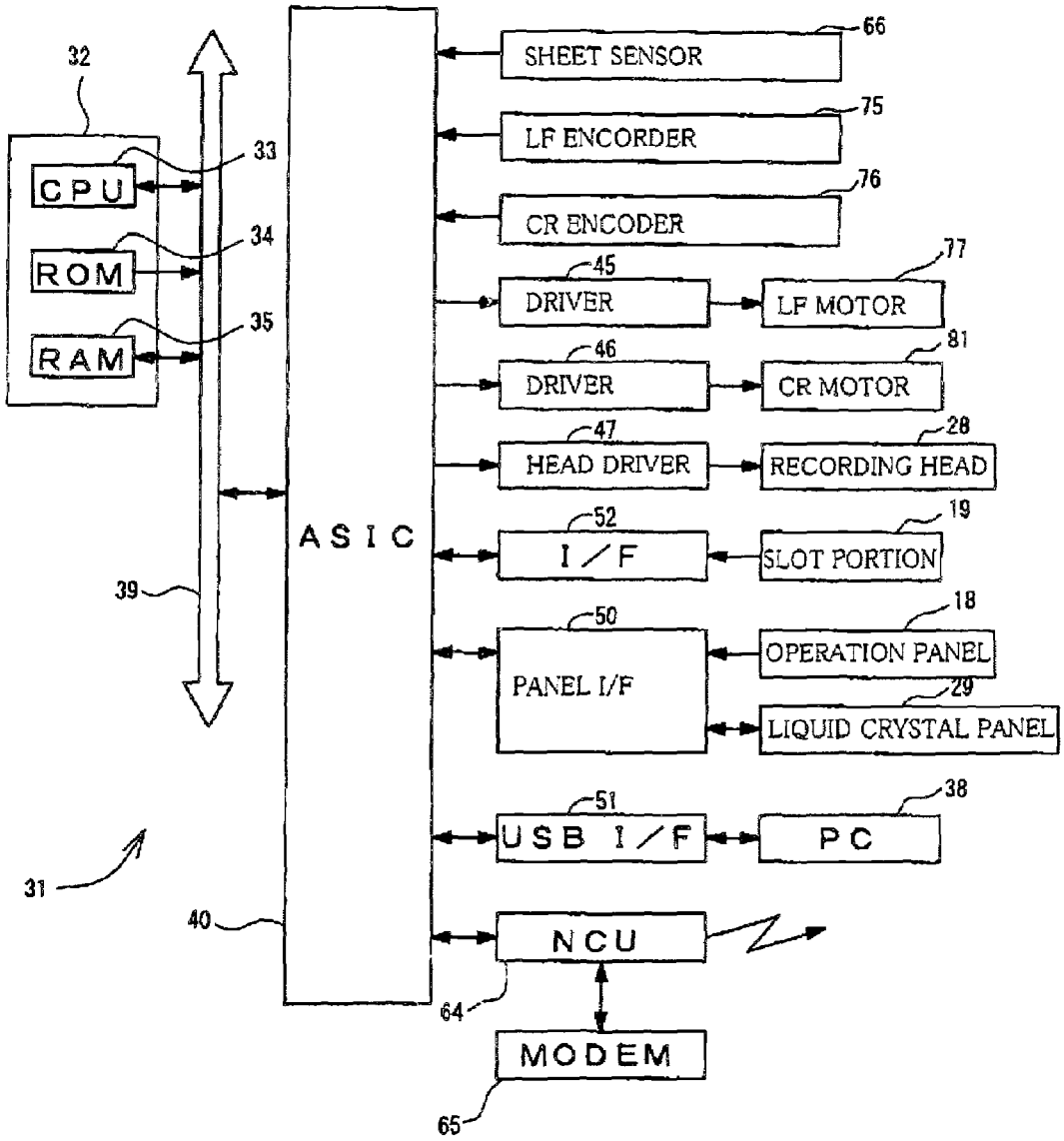
FIG. 3 is a diagrammatic view of a control device of the MFD.

The MFD 10 has, in an upper and left portion of the front surface thereof, the slot portion 19 into which a small-size memory card such as a data memory can be inserted. As shown in FIG. 3, the control device 31 receives image data from the memory card inserted in the slot portion 19, and controls the LCD 29 to display images represented by the received image data. In addition, the control device 31 controls the printer portion 11 to record or print an appropriate image or images that is or are selected, through the operation of the buttons 36, from the images displayed by the LCD 29.

Figure 2:
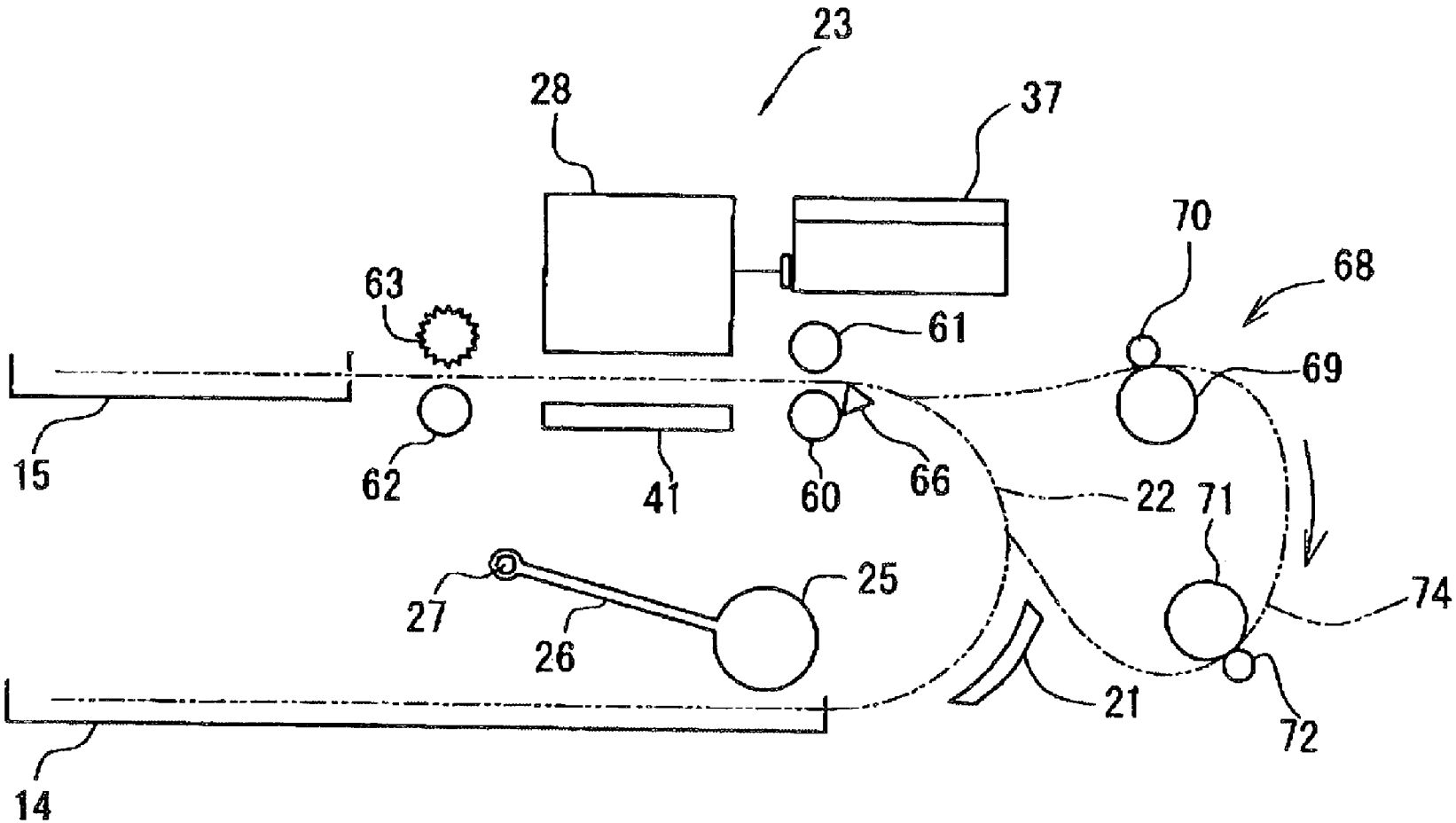
FIG. 2 is a schematic view of a printer portion of the MFD that corresponds to the ink-jet recording apparatus.

FIG. 2 schematically shows a construction of the printer portion 11 of the MFD 10. A direction perpendicular to the drawing sheet of FIG. 2 is the lengthwise direction of the MFD 10.

The sheet-supply tray 14 is provided in a bottom portion of the MFD 10. On a rear side of the sheet-supply tray 14, i.e., on a right-hand side of the same 14 as seen in FIG. 2, there is provided a sheet-separate inclined plate 21 that separates each one recording sheet from the remaining recording sheets accommodated by the sheet-supply tray 14, and guides the each recording sheet upward. A sheet-feed path 22 first extends upward from the sheet-separate inclined plate 21, and then curves leftward, i.e., frontward. Further, the sheet-feed path 22 reaches the sheet-discharge tray 15 via an image recording portion 23. Thus, each of the recording sheets accommodated by the sheet-supply tray 14 is fed along the sheet-feed path 22 including a U-turn portion where a direction of feeding of the each recording sheet is changed from the rearward direction to the frontward direction, and eventually reaches the image recording portion 23. After the image recording portion 23 records an image or images on the recording sheet being fed along the sheet-feed path 22, the recording sheet is discharged onto the sheet-discharge tray 15.

A sheet-supply roller 25 whose arrangement is known in the art is provided above the sheet-supply tray 14, and separates and supplies the recording sheets, stacked in the tray 14, one by one, toward the sheet-feed path 22. In the present embodiment, the sheet-supply roller 25 is rotatably supported by a lower end portion of a sheet-supply arm 26 that is pivotable downward to contact the tray 14, and upward to move away from the same 14. The sheet-supply roller 25 is connected to an electric motor, not shown, via a driving-force transmission device, not shown, that includes a plurality of gears meshed with each other. When the electric motor is operated or rotated, the driving force of the motor is transmitted to the sheet-supply roller 25, so that the roller 25 is driven or rotated and sends out each recording sheet to the sheet-feed path 22.

The sheet-supply arm 26 is supported by a base-end axis member 27, such that the arm 26 is pivotable about the axis member 27. Thus, the sheet-supply arm 26 is swingable upward and downward about the axis member 27. In a state in which the sheet-supply tray 14 is attached to the MFD 10, the sheet-supply arm 26 is biased toward the tray 14 by a clutch and/or a spring, not shown; and in a state in which the tray 14 is detached from the MFD 10, the arm 26 is kept at an upper dead position thereof. When the sheet-supply arm 26 is swung downward, the sheet-supply roller 25 rotatably supported by the lower end of the arm 26 is kept in pressed contact with the uppermost one of the recording sheets stacked in the sheet-supply tray 14; and when the roller 25 is rotated, a friction force produced between an outer circumferential surface of the roller 25 and an upper surface of the uppermost recording sheet sends out the recording sheet toward the sheet-separate inclined plate 21. A leading end of the recording sheet engages the inclined plate 21, and is deflected by the same 21 upward into the sheet-feed path 22. When the sheet-supply roller 25 sends out the uppermost recording sheet, another or additional recording sheet underlying the uppermost one may be sent out together with the uppermost one because of friction and/or static electricity. However, the movement of the additional sheet can be prevented because the additional sheet engages the inclined plate 21.

Except for a portion of the sheet-feed path 22 where the image recording portion 23 is provided, the path 22 is defined by an outer guide surface and an inner guide surface that are opposed to each other and are distant from each other by an appropriate distance. In the MFD 10, the outer guide surface is provided by an inner surface of an outer frame thereof; and the inner guide surface is provided by an outer surface of a guide member provided inside the outer frame. In each curving portion of the sheet-feed path 22, one or more sheet-feed rollers, not shown, are provided such that the sheet-feed rollers are rotatable about respective axis lines parallel to a widthwise direction of the path 22, i.e., the direction perpendicular to the drawing sheet of FIG. 2. The sheet-feed rollers are provided such that the rollers are exposed in the outer or inner guide surface. Since the sheet-feed rollers are provided in each curving portion of the sheet-feed path 22, each recording sheet can be smoothly fed while being guided by the guide surfaces.

The image recording portion 23 is provided on a downstream side of the U-turn portion of the sheet-feed path 22 where the direction of movement of each recording sheet is changed from the rearward direction to the frontward direction. In the present embodiment, as described above, the printer portion 11 is constituted by the ink-jet recording apparatus. Thus, the printer portion 11 or the image recording portion 23 includes an ink-jet recording head 28. A platen 41 is opposed to the recording head 28. The image recording portion 23 additionally includes an ink tank or cartridge 37 that stores a plurality of sorts of inks, such as a black ink, a yellow ink, a magenta ink, and a cyan ink, in a separated manner. Those inks are supplied from the ink tank 37 to the recording head 28, so that the head 28 ejects droplets of the inks toward each recording sheet.

The recording head 28 is mounted on a carriage, not shown, that is moved by a carriage (CR) motor 81, in a main scan direction, i.e., the direction perpendicular to the drawing sheet of FIG. 2. The position of the carriage or the recording head 28 is monitored by a carriage (CR) encoder 76. While the carriage is moved by the CR motor 81, the recording head 28 ejects droplets of the inks toward the recording sheet and thereby records an image thereon. The printer portion 11 employs a known ink supplying means for supplying the inks from the ink tank 37 to the recording head 28, and a known ink ejecting means for ejecting the droplets of the inks from the recording head 28.

On an upstream side of the recording head 28 along the sheet-feed path 22, there are provided a feed roller 60 as a drive roller and a presser roller 61 as a follower roller that function as a pair of upstream-side rollers. The feed roller 60 is driven or rotated by a line-feed (LF) motor 77 in each of a forward direction and a backward direction. When the LF motor 77 is rotated in the forward direction, the recording sheet is fed in a downstream direction along the sheet-feed path 22; and when the LF motor 77 is rotated in the backward direction, the recording sheet is fed in an upstream direction along the sheet-feed path 22. The feed roller 60 and the presser roller 61 cooperate with each other to pinch the recording sheet being fed along the sheet-feed path 22, and send the recording sheet onto an upper flat surface of a platen 41. The feeding of the recording sheet is monitored by a line-feed (LF) encoder 75. More specifically described, the LF encoder 75 includes an encoder disk that is attached to an axis member of the feed roller 60 about which the roller 60 is rotated; and an optical sensor that detects slits of the disk and produces pulse signals. Thus, a number of rotations of the feed roller 60 is detected by the LF encoder 75, and accordingly a distance of feeding of the recording sheet is calculated by the control device 31 in a known manner.

A sheet sensor 66 as a portion of a sheet-trailing-end detector is provided at an appropriate position in the sheet-feed path 22, i.e., on an upstream side of the feed roller 60 and the presser roller 61. The sheet sensor 66 outputs an ON signal when the sensor 66 detects a recording sheet, and outputs an OFF signal when the sensor 66 does not detect the recording sheet. Therefore, when the trailing end of the recording sheet passes over the sheet sensor 66, the output signal of the sensor 66 changes from the ON signal to the OFF signal, and this change is inputted as a sheet-trailing-end detection signal to the control device 31. Based on the sheet-trailing-end detection signal, the control device 31 recognizes a current position of the trailing end of the recording sheet.

On a downstream side of the recording head 28 along the sheet-feed path 22, there are provided a discharge roller 62 as a drive roller and a presser roller 63 as a follower roller that function as a pair of downstream-side rollers. The discharge roller 62 is driven or rotated by the LF motor 77. More specifically described, the discharge roller 62 is rotated in each of a forward direction and a backward direction, in synchronism with the feed roller 60, by the LF motor 77 via a synchronizing device, not shown. The discharge roller 62 and the pressure roller 63 cooperate with each other to pinch the recording sheet onto which the ink droplets have been ejected and, when the LF motor 77 is rotated in the forward direction, the recording sheet is fed downstream along the sheet-feed path 22 and, when the LF motor 77 is rotated in the backward direction, the recording sheet is fed upstream along the sheet-feed path 22. This feeding of the recording sheet is also monitored by the LF encoder 75. Thus, a number of rotations of the discharge roller 62 is detected by the LF encoder 75 via the feed roller 60, and accordingly a distance of feeding of the recording sheet is calculated by the control device 31.

Figure 4:
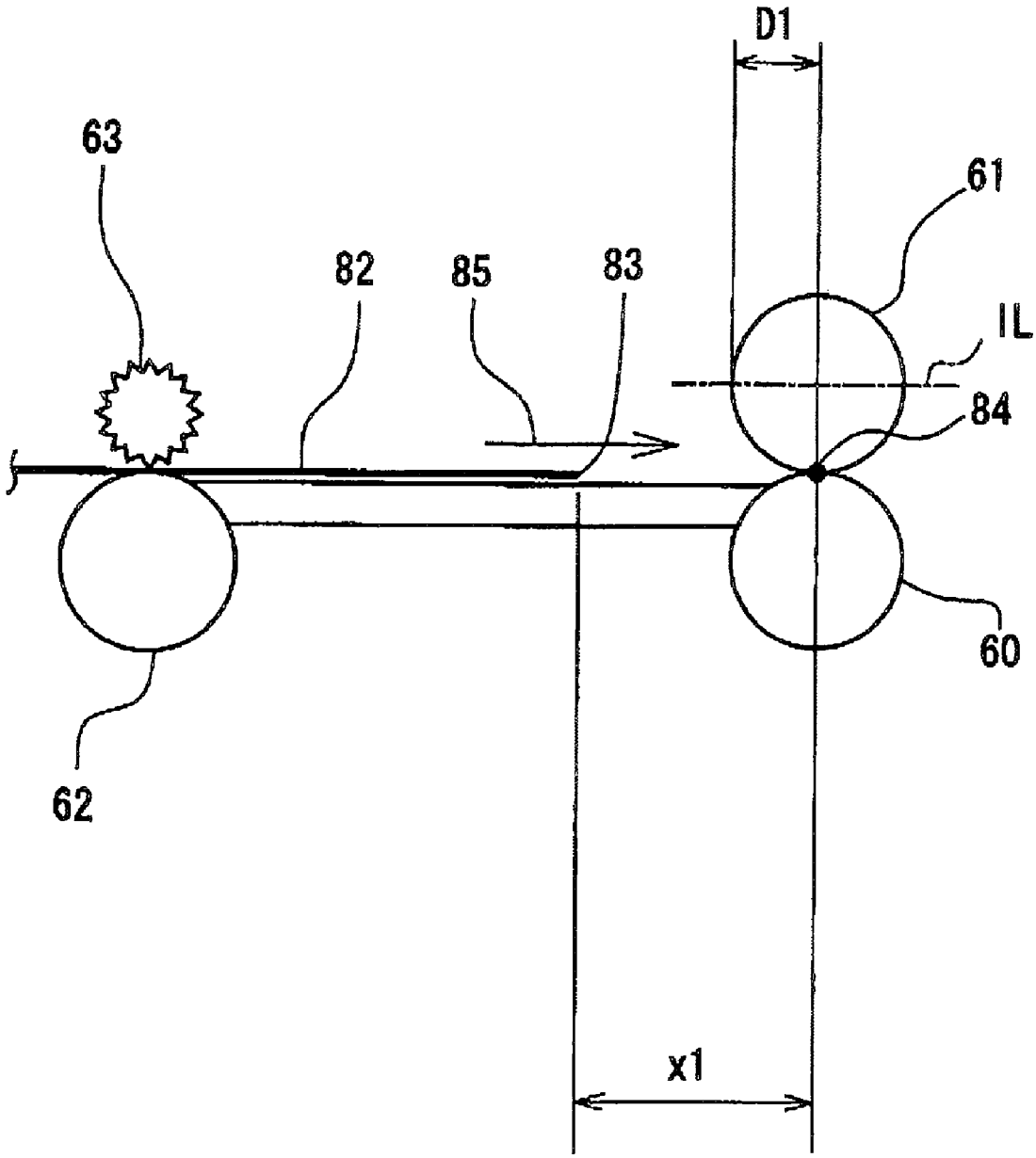
FIG. 4 is an enlarged plan view of a relevant portion of the MFD.

The presser roller 61 is elastically biased, with an appropriate pressing force, against the feed roller 60 by an elastic member such as a spring, or an elastic portion of an axis member of the roller 61. Therefore, when the recording sheet is moved toward the feed roller 60 and the presser roller 61, the presser roller 61 cooperates with the feed roller 60 to nip the recording sheet while being elastically moved back by a distance corresponding to the thickness of the sheet. Hereinafter, the position where the feed roller 60 and the presser roller 61 contact or engage each other will be referred to as a nip position 84 (FIG. 4) where the two rollers 60, 61 nip the recording sheet. Since the recording sheet is nipped by the feed roller 60 and the presser roller 61, the rotation force of the feed roller 60 is reliably transmitted to the sheet. This is also the case with the discharge roller 62 and the presser roller 63. However, in the present embodiment, since the presser roller 63 is pressed on the recording sheet having the image on the upper surface thereof, the pressure roller 63 is provided by a spur roller having a plurality of projections on a rolling surface thereof, as shown in FIG. 4, so as not to deteriorate the image recorded on the sheet. However, each of the two presser rollers 61, 63 may have an elastically deformable rolling surface (i.e., outer circumferential surface) that is elastically deformed inward, when nipping the recording sheet, by an amount corresponding to the thickness of the sheet.

The recording sheet nipped by the feed roller 60 and the presser roller 61 is intermittently fed downward over the platen 41, at a predetermined pitch equal to a width of each image line recorded by the recording head 28. Each time one image line is recorded by the recording head 28, the head 28 is reciprocated in the above-described main scan direction. The recording of image lines starts with a leading-end portion of the recording sheet. The discharge roller 62 and the presser roller 63 cooperate with each other to start nipping the leading-end portion of the recording sheet on which the image lines have been recorded. More specifically described, in a state in which a downstream-side portion of the recording sheet is nipped by the discharge roller 62 and the presser roller 63 and an upstream-side portion of the same sheet is nipped by the feed roller 60 and the presser roller 61, the recording sheet is intermittently fed downward at the predetermined pitch equal to the width of each image line. Thus, image lines are recorded on the recording sheet by the recording head 28 while the sheet is intermittently fed downward. In particular, in the no-margin printing mode, image lines are recorded up to the trailing end of the recording sheet, without leaving any margins, and accordingly the sheet is fed downward even after the trailing end of the sheet has passed through the feed roller 60 and the presser roller 61. That is, even after the recording sheet has been released from the nipping of the feed roller 60 and the presser roller 61, the sheet is intermittently fed downward by the discharge roller 62 and the presser roller 63 at the predetermined pitch equal to the width of each image line. After image lines have been recorded in a pre-determined area on the recording sheet, the discharge roller 62 is continuously rotated so that the sheet is released from the nipping of the discharge roller 62 and the presser roller 63 and is discharged onto the discharge tray 15.

In the double-side printing mode in which image lines are recorded on each of opposite surfaces of a recording sheet, after the recording of image lines on one surface of the sheet has ended, the feed roller 60 and the discharge roller 62 are rotated in the backward direction. Thus, the recording sheet is fed upstream along the sheet-feed path 22, and then is caused to leave the path 22. More specifically described, as shown in FIG. 2, a sheet reversing device 68 is provided on an opposite side of the feed roller 60 and the presser roller 61 that is opposite to the recording portion 23 or the recording head 28. The sheet reversing device 68 is for reversing, at a position off the sheet-feed path 22, the recording sheet having the image on the upper (i.e., one) surface thereof, upside down, and introducing the sheet into the path 22 again. The recording sheet, reversed upside down, is fed to the platen 41 again, and image lines are recorded on the new, upper (i.e., other) surface of the sheet by the recording head 28. When the upper (or lower) surface of the recording sheet is reversed to the lower (or upper) surface thereof by the sheet reversing device 68, the trailing end of the sheet is changed to the leading end thereof.

As shown in FIG. 2, the sheet reversing device 68 includes a first reverse roller 69 and a presser roller 70, and a second reverse roller 71 and a presser roller 72. The sheet reversing device 68 has a sheet-reverse path 74, indicated by two-dot chain line, and the recording sheet fed upstream along the sheet-feed path 22 is reversed upside down by being fed downstream along the sheet-reverse path 74.

The presser roller 70 is elastically biased, with an appropriate pressing force, against the first reverse roller 69. When the first reverse roller 69 is rotated by an electric motor, not shown, the recording sheet is fed downstream, i.e., in a direction indicated by arrow along the sheet-reverse path 74. The second reverse roller 71 and the presser roller 72 that have the same arrangements as those of the first reverse roller 69 and the presser roller 70 are provided in a downstream-side portion of the sheet-reverse path 74. The presser roller 72 is elastically biased, with an appropriate pressing force, against the second reverse roller 71. Therefore, when the recording sheet is fed downstream along the sheet-reverse path 74, the sheet is nipped by the second reverse roller 71 and the presser roller 72 and, when the second reverse roller 71 is rotated, the sheet is returned from the sheet-reverse path 74 to the sheet-feed path 22.

Thus, when the recording sheet is returned from the sheet-reverse path 74 to the sheet-feed path 22, the lower surface of the sheet has been reversed to the upper surface thereof, and the trailing end thereof has been changed to the leading end thereof, so that the feed roller 60 and the presser roller 61 cooperate with each other to start nipping the leading end of the sheet and feed the sheet onto the platen 41 such that the recording head 28 is opposed to the upper surface of the sheet. Then, like the recording of image lines on one surface of the recording sheet, image lines are recorded on the other surface of the sheet by the recording head 28 while the head 28 is moved in the main scan direction. After the recording of the image lines on the other surface of the recording sheet has ended, the sheet is nipped by the discharge roller 62 and the presser roller 63, is fed downstream along the sheet-feed path 22, and is discharged onto the discharge tray 15. Thus, images are recorded on the opposite surfaces of the recording sheet.

FIG. 3 diagrammatically shows a construction of the control device 31 of the MFD 10.

The control device 31 employs a central processing portion 32 including a CPU (central processing unit) 33, a ROM (read only memory) 34, and a RAM (random access memory) 35. The central processing portion 32 is connected via a bus 39 and an ASIC (application specific integrated circuit) 40 to the various sensors (i.e., the sheet sensor 66, the LF encoder 75, and the CR encoder 76), the LF motor 77, the CR motor 81, the recording head 28, the slot portion 19, the operation panel 18, the LCD 29, the PC 38, the scanner portion 12, and the sheet reversing device 68, in such a manner that the central processing portion 32 can communicate data with each of the elements 18, 19, 29, 38.

The ROM 34 stores, e.g., control programs used to control the various operations of the MFD 10. The RAM 35 is used as a memory area or an operation area that temporarily stores various sorts of data needed for the CPU 33 to implement the above-indicated control programs. The ASIC 40 outputs, according to commands supplied from the CPU 33, drive signals to drive, e.g., the LF motor 77 and the CR motor 81. Based on those drive signals, the respective operations of the printer portion 11 and the scanner portion 12 are controlled in an integrated manner.

The CPU 33 reads an appropriate control program stored by the ROM 34, and temporarily stores it in the RAM 35. As will be described later, the CPU 33 operates, according to this control program, for recognizing the current position of each recording sheet, operating the LF motor 77 to feed the recording sheet, and operating the CR motor 81 and the recording head 28 to record images on the sheet. In addition, through operation of the operation panel 18 by a user, various printing modes and parameters are set and selected. The printing modes and parameters include the single-side or double-side printing mode, the margin-leaving or no-margin printing mode, the degree of printing resolution, the size of recording sheets, and the number of recording sheets.

The various sensors (e.g., the sheet sensor 66), the LF motor 77, the CR motor 81, the recording head 28, the slot portion 19, the scanner portion 12, the operation panel 18, the LCD 29, the PC 38, and the sheet reversing device 68 are connected to the ASIC 40. In particular, the LF motor 77, the CR motor 81, and the recording head 28 are connected to the ASIC 40 via respective driver circuits 45, 46, 47. The ASIC 40 can send and receive signals to and from each of the operation panel 18 and the LCD 29 via a panel interface (I/F) 50. In addition, the ASIC 40 can send and receive data to and from the PC 38 via a USB interface (I/F) 51, and can send and receive data to and from the slot portion 19 via an interface (I/F) 52. Thus, the MFD 10 can record, based on image data or document data sent from the PC 38 or the memory card inserted in the slot portion 19, images or documents on recording sheets.

As shown in FIG. 3, an NCU (network control unit) 64 and a modem 65 are connected to the ASIC 40, and cooperate with each other to enable the MFD 10 to function as a facsimile machine. When the NCU 64 and the modem 65 receive facsimile data from a remote device, the NCU 64 operates for temporarily storing the received facsimile data in the RAM 35. The CPU 33 operates, according to the control program, for converting the facsimile data into printing data. In addition, the CPU 33 operates, according to the control program, for operating, based on the printing data, the LF motor 77 to feed the recording sheet and operating the CR motor 81 and the recording head 28 to record images on the sheet. Thus, the received facsimile data are outputted in the form of the images recorded on the recording sheet. However, facsimile data may be outputted in different manners. For example, facsimile data may be outputted, i.e., printed out by so-called "ondemand" reception, or may be outputted, i.e., stored in a memory of the PC 38 connected to the MFD 10 via the I/F 51.

Figure 5:
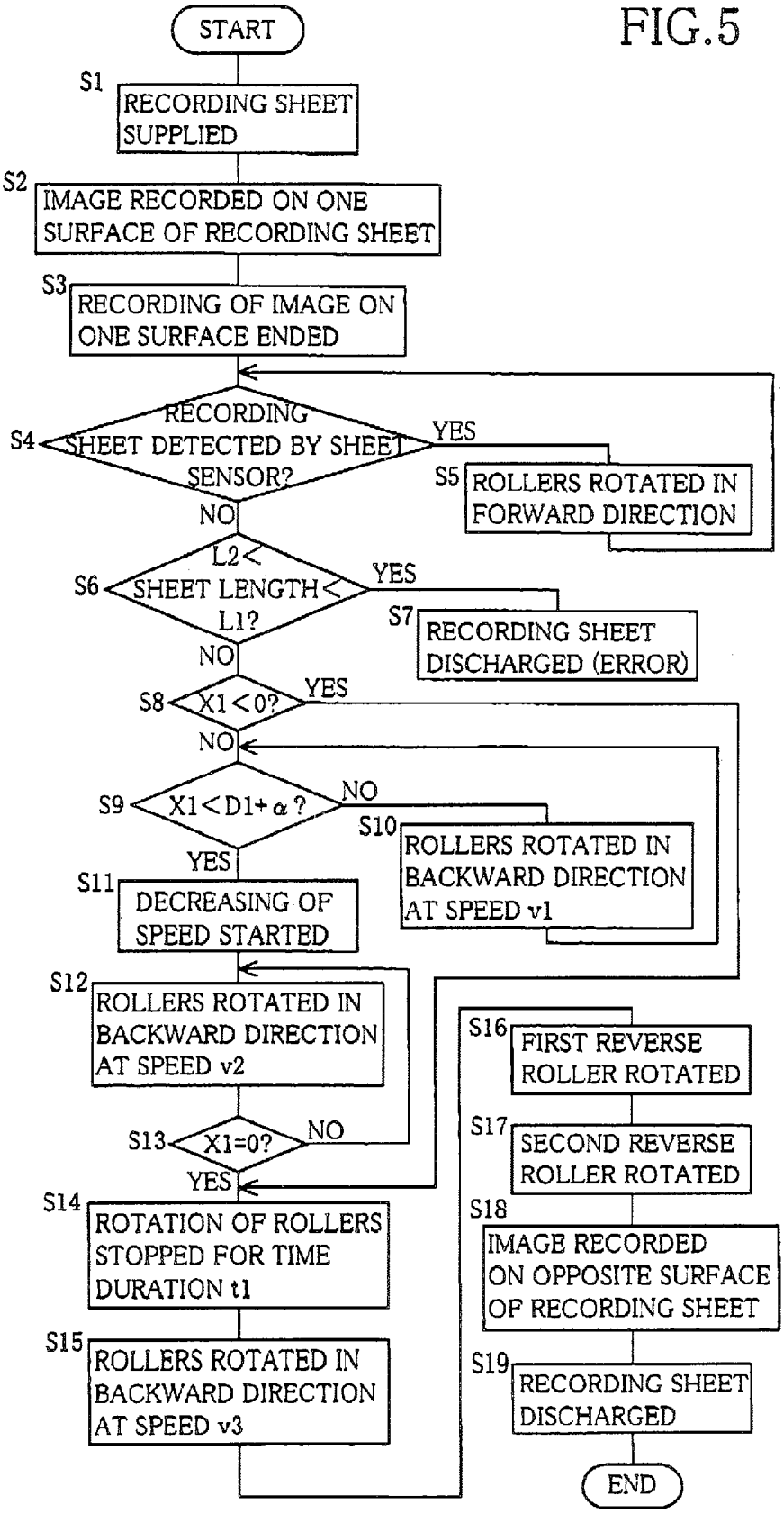
FIG. 5 is a flow chart representing steps of a double-side and no-margin printing operation of the MFD.

FIG. 4 is an enlarged view of a relevant portion of the MFD 10, and shows a manner in which a recording sheet 82 is fed downstream and upstream by the feed roller 60 and the discharge roller 62. FIG. 5 is a flow chart representing a manner in which the MFD 10 operates in the double-side and no-margin printing modes.

The MFD 10 records or prints a desirable image on each of opposite sides or surfaces of the recording sheet 82, without leaving any margins thereon, as follows: First, a user operates the operation panel 18 so as to set the double-side printing mode and the no-margin printing mode. However, the user may set the single-side printing mode or the margin-leaving printing mode. At Step S1, a printing operation is started, that is, the sheet-supply roller 25 is rotated to supply one recording sheet 82 from the sheet-supply tray 14. More specifically described, the recording sheet 82 is fed along the sheet-feed path 22, is passed over the sheet sensor 66, is nipped by the feed roller 60 and the presser roller 61, and is positioned on the platen 41. Then, at Step S2, the recording sheet 82 is intermittently fed downstream along the sheet-feed path 22 by the feed roller 60 and the presser roller 61, while the recording head 28 ejects droplets of the inks toward the sheet 82. Thus, a desirable image is recorded on one (i.e., currently upper) surface of the recording sheet 82. In the no-margin printing mode, the image lines are recorded up to a trailing end or edge 83 of the recording sheet 82. Thus, at Step S3, the recording of image on one surface of the recording sheet 82 ends.

Next, another image is recorded on the other (i.e., currently lower) surface of the recording sheet 82. To this end, the currently lower surface of the recording sheet 82 is reversed to the upper surface, i.e., the currently upper surface of the sheet 82 is reversed to the lower surface. More specifically described, at Step S4, the control device 31 judges whether the sheet sensor 66 is detecting the recording sheet 82. As described above, in the no-margin printing mode, droplets of the inks are ejected toward the recording sheet 83, up to the trailing end 83 thereof. Therefore, during the printing operation, the trailing end 83 of the recording sheet 82 is passed through the nip position 84 of the feed roller 60 and the presser roller 61 and, when the recording of image on one surface of the recording sheet 82 ends, the trailing end 83 is positioned at a position right below ink ejection nozzles (not shown) of the recording head 28.

However, for example, when, in the margin-leaving printing mode, the recording of image on one surface of the recording sheet 82 ends, the trailing end 83 of the sheet 82 may not have been passed through the nip position 84, and the sheet sensor 66 is detecting the sheet 82. In this case, a positive judgment is made at Step S4, and the control of the control device 31 goes to Step S5 to feed the recording sheet 82 downstream along the sheet-feed path 22 till the trailing end 83 of the sheet 82 is passed over the sheet sensor 66, i.e., through the nip position 84.

In the no-margin printing mode, when the recording of image on one surface of the recording sheet 82 ends, the trailing end 83 is positioned at the position right below the nozzles of the recording head 28. Therefore, the sheet sensor 66 has detected the trailing end 83 of the recording sheet 82, and produces the OFF signal following the ON signal. Thus, the control device 31 detects or recognizes a time when the trailing end 83 is passed through the nip position 84. Based on this detected time and the output signals of the LF encoder 75 corresponding to the feed roller 60, the control device 31 can accurately detect or recognize the current position of the trailing end 83 of the recording sheet 82. In FIG. 4, this position is represented by a distance, x1, of the trailing end 83 as measured from the nip position 84 in the downstream direction as a positive direction.

Meanwhile, if a negative judgment is made at Step S4, the control goes to Step S6 to judge whether a length of the recording sheet 82 is appropriate for the double-side printing mode. More specifically described, in the double-side printing mode, the recording sheet 82 needs to be reversed by the sheet reversing device 68. To this end, the length of the recording sheet 82 needs to fall within an appropriate range corresponding to the length of the sheet-reverse path 74, i.e., be smaller than an upper limit, L1, and greater than a lower limit, L2. The upper limit L1 is, e.g., a length of a path including a distance between the feed roller 60 and the first reverse roller 69, a distance between the first and second reverse rollers 69, 71, and a distance between the second reverse roller 71 and the feed roller 60; and the lower limit L2 is, e.g., the distance between the second reverse roller 71 and the feed roller 60. If the length of the recording sheet 82 is greater than the upper limit L1 or smaller than the lower limit L2, the sheet 82 cannot be reversed. Therefore, if a negative judgment is made at Step S6, the control device 31 recognizes occurrence of an error, and the control goes to Step S7 to feed the recording sheet 82 downstream along the sheet-feed path 22 and discharge the sheet 82 to the discharge tray 15. The length of the recording sheet 82 can be detected or measured as a distance of feeding of the sheet 82 during a time duration from a time when the leading end of the sheet is detected by the sheet sensor 66 (i.e., when the OFF signal is changed to the ON signal) and to a time when the trailing end of the sheet 82 is detected by the sensor 66 (i.e., when the ON signal is changed to the OFF signal).

On the other hand, if a positive judgment is made at Step S6, the control goes to Step S8 to judge whether the distance x1 is negative, i.e., whether the trailing end 83 of the recording sheet 82 is completely nipped at the nip position 84. If a positive judgment is made at Step S8, the control goes to Step S14 to temporarily stop the feeding of the recording sheet 82 and wait for a pre-determined time duration, t1. This time duration t1 is pre-determined at a time duration needed for the droplets of inks ejected onto the upper surface of the recording sheet 82 to dry up. For example, the time duration t1 is longer than 0 second and shorter than 20 seconds.

On the other hand, if a negative judgment is made at Step S8, the control goes to Step S9 to judge whether the distance x1 is smaller than a positive distance, D1+$\alpha$. The distance D1 is equal to a radius of the presser roller 61, i.e., a length of a radius range between the nip position 84 and an outer end of the presser roller 61 as an upper one of the two rollers 60, 61. Therefore, in a modified embodiment wherein the feed roller 60 is located above the presser roller 61, the distance D1 is equal to a radius of the feed roller 60 as an upper one of the two rollers 60, 61. The value $\alpha$ takes an appropriate positive value, e.g. 2.0 mm. The distance D1, i.e., the radius of the presser roller 61 is not less than 1 mm and not more than 5 mm. Hereinafter, the above-indicated radius range between the nip position 84 and the outer end of the presser roller 61 will be referred to as the "jamming prevention range" where the jamming of recording sheet 82 is prevented.

In the no-margin printing mode, when the recording of image on one surface of the recording sheet 82 ends, the trailing end 83 of the recording sheet 82 is positioned at the position right below the nozzles of the recording head 28 (FIG. 2). In this case, therefore, a negative judgment is made at Step S9, and the control goes to Step S10 to feed the recording sheet 82 upstream along the sheet-feed path 22, i.e., in a direction indicated by an arrow 85, at a feeding speed, v1. In the present embodiment, the feeding speed v1 is lower than a feeding speed (e.g., from 20 ips (inch per second) to 1.15 ips) at which the recording sheet 82 is fed downstream along the path 22 by the feed roller 60 and the discharge roller 62 when an image is recorded on each of opposite surfaces of a recording sheet 82. Thus, the recording sheet 82 can slowly enter the jamming prevention range D1. However, the feeding speed v1 may be selected to be equal to, e.g., the feeding speed at which the recording sheet 82 is discharged by the discharge roller 62 (i.e., fed by the feed roller 60), i.e., the highest speed at which the discharge roller 62 (or the feed roller 60) can be rotated to discharge or feed the sheet 82. In the double-side and no-margin printing modes, as soon as the recording of image on one surface of the recording sheet 82 ends at Step S3, the feeding of the sheet 82 in the upstream direction at the speed v1 at Step 10 is started.

Meanwhile, if a positive judgment is made at Step S9, the control goes to Step S11 to lower the feeding speed v1, so that at Step S12, when the trailing end 83 of the recording sheet 82 enters the jamming prevention range D1, the sheet 82 is fed upstream at a feeding speed, v2, in the direction indicated by the arrow 85. More specifically described, when the trailing end 83 of the recording sheet 82 reaches an appropriate position before the jamming prevention range D1, braking of the sheet 82 is started, i.e., lowering of the feeding speed v1 is started, so that the trailing end 83 enters the range D1 at the lowered feeding speed v2. The appropriate position is defined by the above-indicated distance $\alpha$. The distance $\alpha$ may be changed based on the feeding speeds v1, v2. In the present embodiment, the feeding speed v2 lower than the feeding speed v1 is pre-determined such that even if, when the trailing end 83 of the recording sheet 82 enters the jamming prevention range D1, the trailing end 83 may engage the presser roller 61 or the feed roller 60, the recording sheet 82 as a whole does not deform like bellows. The feeding speed v2 is not higher than 3 ips, preferably not higher than 1 ips. Thus, in the double-side and no-margin printing modes, within a first predetermined time duration starting from the time when the recording of image on one surface of the recording sheet 82 ends at Step S3, the trailing end 83 of the recording sheet 82 reaches the jamming prevention range D1, at Step S12. The first predetermined time duration falls in a range of from 0.1 seconds to 3 seconds, preferably, a range of from 0.1 seconds to 1 second.

Step S12 is followed by Step S13 to judge whether the distance x1 is equal to zero (x1=0), i.e., whether the trailing end 83 of the recording sheet 82 has reached the nip position 84. If a negative judgment is made at Step S13, the control goes back to Step S12 to continue feeding the sheet 82 upstream at the feeding sheet v2.

On the other hand, if a positive judgment is made at Step S13, the control goes to Step S14. At Step S14, as described above, the feeding of the recording sheet 82 is temporarily stopped for the pre-determined time duration t1 as a second pre-determined time duration. More specifically described, in the state in which the trailing end 83 of the recording sheet 82 is positioned at the nip position 84, the rotation of the discharge roller 62 (and the feed roller 60) is stopped for the time duration t1. The time duration t1 is pre-determined at a time duration assuring that the droplets of inks injected onto a pre-determined portion of the sheet 82 that is located in the vicinity of the trailing end 83 thereof dry up.

After the time duration t1 elapses, the control goes to Step S15 to rotate the discharge roller 62 and the feed roller 60 in the backward direction so as to feed the recording sheet 82 upstream at a feeding speed, v3, higher than the feeding speed v2. The feeding speed v3 may be pre-determined to be equal to the highest speed at which the feed roller 60 (or the discharge roller 62) can be rotated. Thus, the trailing end 83 of the recording sheet 82 is reliably nipped at the nip position 84 by the feed roller 60 and the presser roller 61.

Since the recording sheet 82 is fed upstream along the sheet-feed path 22 by the discharge roller 62 and the feed roller 60, the sheet 82 eventually enters the sheet-reverse path 74, shown in FIG. 2. Then, at Step S16, the first reverse roller 69 of the sheet reversing device 68 is rotated to feed the recording sheet 82 along the sheet-reverse path 74. In addition, at Step S17, when the recording sheet 82 reaches the second reverse roller 71, the second reverse roller 71 is rotated to return the sheet 82 from the sheet-reverse path 74 to the sheet-feed path 22. At that time, the lower (i.e., other) surface of the recording sheet 82 on which no image has been recorded has been reversed to the upper surface thereof, so that the upper surface can be opposed to the recording head 28.

The recording sheet 82, returned to the sheet-feed path 22, is fed downstream along the path 22, and is passed over the sheet sensor 66, as it was done at Step S1. The feed roller 60 and the presser roller 61 cooperate with each other to nip the recording sheet 82 and send the sheet 82 to the platen 41. Furthermore, at Step S18, the feed roller 60 feeds the recording sheet 82 downstream along the sheet-feed path 22, while the recording head 28 ejects droplets of the inks toward the sheet 22 so as to record a desirable image on the upper (i.e., other) surface of the sheet 82. When the recording of image on the other surface of the recording sheet 82 ends. Step S18 is followed by Step S19 where the discharge roller 62 is rotated to discharge the sheet 82 onto the discharge tray 15.

As is apparent from the foregoing description of the MFD 10, the desirable images are recorded on the opposite surfaces of the recording sheet 82 such that after the droplets of inks ejected onto one of the opposite surfaces of the sheet 82 dry up, the sheet 82 is reversed upside down, and then the droplets of inks are ejected onto the other surface of the sheet 82. Therefore, when the recording sheet 82 is fed upstream, the inks ejected onto the sheet 82 are not adhered to the presser roller 61, and accordingly the image recorded on the sheet 82 is not distorted.

In addition, at the time when the recording of image on one surface of the recording sheet 82 ends, the current position of the trailing end 83 of the sheet 82 is recognized by the control device 31. If the recognized position of the trailing end 83 is located out of the jamming prevention range D1, the recording sheet 82 is immediately fed upstream at the speed v1. More specifically described, in the process in which the droplets of inks ejected onto the one surface of the recording sheet 82 are drying up and the phenomenon of cockling is occurring to the sheet 82, the sheet 82 is fed upstream such that before the trailing (now leading) end 83 of the sheet 82 deforms upward to reach a position on or above a horizontal, straight phantom line, IL, (FIG. 4) passing through the center of rotation of the presser roller 61, i.e., within the first pre-determined time duration, the trailing end 83 enters the jamming prevention range D1. Then, the trailing end 83 of the recording sheet 82 is nipped by the feed roller 60 and the presser roller 61, and is fed to the sheet reversing device 68 after the first pre-determined time duration. Thus, after the trailing end 83 of the recording sheet 82 enters the jamming prevention range D1, the occurrence of the cockling phenomenon finishes or completes. Therefore, the trailing end 83 of the recording sheet 82 is nipped by the feed roller 60 and the presser roller 61, without causing the jamming of the sheet 82. The first pre-determined time duration may be pre-determined based on a sort of the material of the recording sheet 82 and/or an amount of the ink droplets ejected onto a pre-determined portion of the sheet 82 in the vicinity of the trailing end 83 thereof. Therefore, at Step S10 of FIG. 5, the control device 31 may determine or change the feeding speed v1 based on at least one of the material of the recording sheet 82 selected through the operation panel 18 and/or the amount of ink droplets ejected onto the pre-determined portion of the sheet 82 in the vicinity of the trailing end 83 thereof at Step S2. The amount of the ink droplets can be calculated by the control device 31 by multiplying the total number of the ink droplets by a volume of ink of each ink droplet.

In other words, in the MFD 10, the trailing end 83 of the recording sheet 82 enters the jamming prevention range D1 before the occurrence of the cockling phenomenon as one of the major causes of sheet jamming finishes. Therefore, even in the double-side and no-margin printing modes, the jamming of the recording sheet 82 can be reliably prevented. In addition, in the present embodiment, the jamming of the recording sheet 82 is prevented by controlling the feeding of the sheet 82. Thus, the construction of the MFD 10 is not complicated and the production cost of the same 10 is not increased.

In addition, when the recording sheet 82 is reversed upside down after the recording of image on one surface of the sheet 82 ends, the trailing end 83 of the sheet 82 is fed to the jamming prevention range D1 at the high speed v1 that is equal to the speed at which the sheet 82 is discharged by the discharge roller 62. Thus, the recording sheet 82 can reliably enter the jamming prevention range D1 before the droplets of inks have dried up on the one surface of the sheet 82. In addition, in the present embodiment, the recording sheet 82 is fed to the nip position 84 at the low speed v2 lower than the high speed v1. Therefore, the trailing end 83 of the sheet 82 can be reliably nipped by the feed roller 60 and the presser roller 62. Thus, the jamming of the recording sheet 82 can be effectively prevented.

In addition, in the present embodiment, when the trailing end 83 of the recording sheet 82 reaches the nip position 84 at the low speed v2, the sheet 82 is stopped for the pre-determined time duration t1, at Step S14 of FIG. 5, so that the sheet 82 completely dries up. Therefore, though the recording sheet 82 is fed upstream by the feed roller 60, problems such as running of ink, or adhesion of ink to the feed roller 60, can be effectively prevented.

Moreover, the recording sheet 82 is fed upstream from the nip position 84 toward the sheet reversing device 68 at the speed v3 higher than the speed v2. Since the high speed v3 may be equal to the highest speed at which the feed roller 60 can be rotated, the time needed to record the images on the opposite surfaces of the recording sheet 82 can be advantageously reduced.

In addition, in the present embodiment, the feed roller 60 and the presser roller 61 cooperate with each other to nip the recording sheet 82 and feed the sheet 82 to the sheet reversing device 68. Therefore, the reversing of the recording sheet 82 can be done reliably and quickly.

Next, other embodiments of the present invention will be described.

Figure 6:
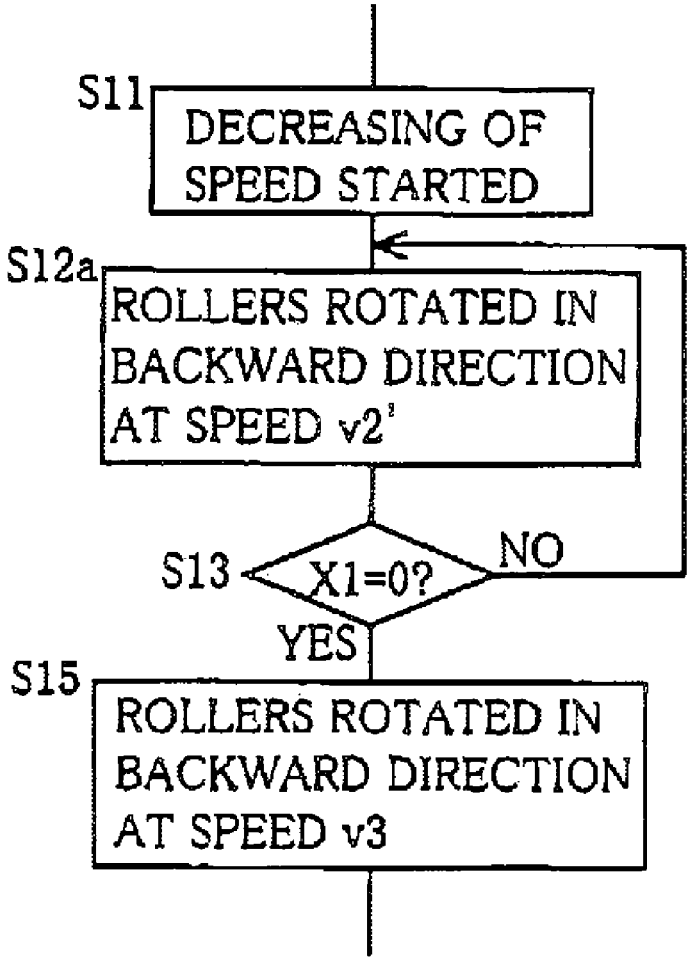
FIG. 6 is a flow chart representing steps of a double-side and no-margin printing operation of another MFD as a second embodiment of the present invention.

In the above-described, first embodiment, the upstream feeding of the recording sheet 82 is temporarily stopped for the pre-determined time duration t1 in which the sheet 82 completely dries up, at Step S14 of FIG. 5. In contrast, in a second embodiment shown in FIG. 6, Step S12 of FIG. 5 is replaced with Step S12a in which the feeding speed v2 used at Step S12 is replaced with such a feeding speed, v2', that assures that the droplets of inks ejected onto the pre-determined portion of the recording sheet 82 in the vicinity of the trailing end 83 thereof dry up during a third pre-determined time duration from the time when the trailing end 83 enters the jamming prevention range d1 to the time when the trailing end 83 reaches the nip position 84. In this case, too, the trailing end 83 of the recording sheet 82 is nipped by the feed roller 60 and the presser roller 61 after the ink droplets have completely dried up. Thus, the ink droplets can be effectively prevented from being adhered to the presser roller 61. In the second embodiment, Step S14 is omitted.

Figure 7:
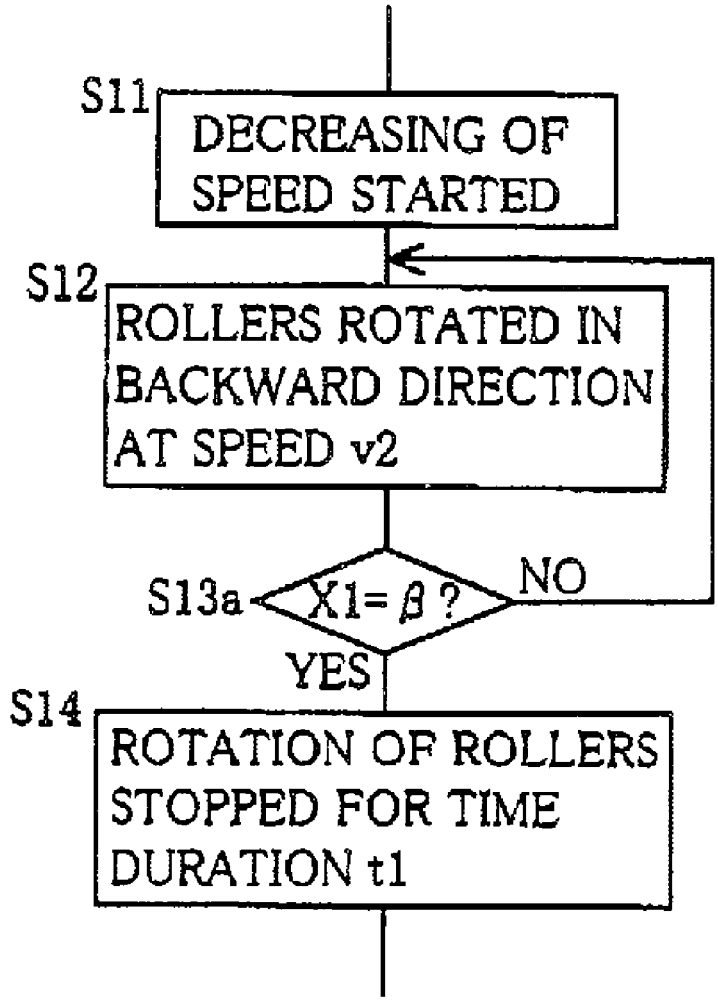
FIG. 7 is a flow chart representing steps of a double-side and no-margin printing operation of another MFD as a third embodiment of the present invention.

In the first embodiment, at Step S13 of FIG. 5, the control device 31 judges whether the distance x1 is equal to zero. However, in a third embodiment shown in FIG. 7, Step S13 of FIG. 5 is replaced with Step S13a in which the control device 31 judges whether the distance x1 is equal to a pre-determined distance, β, that is greater than zero and smaller than the radius D1. If a positive judgment is made at Step S13a, the control goes to Step S14 to temporarily stop the rotation of the four rollers 60, 61, 62, 63 for the pre-determined time duration t1. On the other hand, if a negative judgment is made at Step S13a, the control goes back to Step S12. In the third embodiment, since the trailing end 83 of the recording sheet 82 is stopped at a position within the jamming prevention range D1 and before the nip position 84, the ink droplets ejected to the trailing end 83 can be more effectively prevented from being adhered to the presser roller 61.

It is to be understood that the present invention may be embodied with other changes and improvements that may occur to a person skilled in the art, without departing from the spirit and scope of the invention defined in the claims.

What is claimed is:

1. An ink-jet recording apparatus, comprising:

an ink-jet recording head which ejects droplets of ink toward one of opposite surfaces of a recording sheet so as to record a first image on said one surface;

a pair of upstream-side rollers which are provided on an upstream side of the recording head with respect to a sheet-feed path and which are rotated to feed the recording sheet to the recording head in a downstream direction along the sheet-feed path;

a pair of downstream-side rollers which are provided on a downstream side of the recording head with respect to the sheet-feed path and which are rotated to feed the recording sheet from the recording head in the downstream direction along the sheet-feed path;

at least one rotating device which rotates, in a forward direction corresponding to the downstream direction, the pair of upstream-side rollers and the pair of downstream-side rollers, and rotates, in a backward direction corresponding to an upstream direction opposite to the downstream direction, at least the pair of downstream-side rollers;

a sheet reversing device which reverses, on an opposite side of the pair of upstream-side rollers that is opposite to the recording head, the recording sheet having the first image on said one surface thereof, and which feeds the reversed recording sheet to the pair of upstream-side rollers so that the pair of upstream-side rollers feed the reversed recording sheet to the recording head again so as to record a second image on an other of the opposite surfaces of the reversed recording sheet; and a control device, wherein when the recording head records the first image on said one surface of the recording sheet, the control device controls said at least one rotating device to rotate, in the forward direction, the pair of upstream-side rollers and the pair of upstream-side rollers such that a trailing end of the recording sheet is fed to a position outside a radius range between (a) a nip position where the pair of upstream-side rollers nip the recording sheet and (b) a downstream-side position that is distant from the nip position in the downstream direction by a distance equal to a radius of one of the pair of upstream-side rollers that is located on one side of the sheet-feed path on which side the recording head is provided, wherein the control device controls, in a state in which the pair of upstream-side rollers are maintained in contact with each other, said at least one rotating device to rotate, in the backward direction, the pair of downstream-side rollers to feed the recording sheet in the upstream direction along the sheet-feed path from said position outside said range toward the nip position such that the trailing end of the recording sheet enters said range within a first predetermined time duration, wherein when the recording sheet is fed in the upstream direction toward the nip position, the control device controls said at least one rotating device to decrease a speed of rotation of the pair of upstream-side rollers in the backward direction, such that the trailing end is maintained within said range for at least a second predetermined time duration.

2. The ink-jet recording apparatus according to claim 1, wherein when the pair of downstream-side rollers are rotated in the backward direction to feed the recording sheet in the upstream direction and the trailing end of the recording sheet reaches the nip position, the trailing end is simultaneously nipped by the pair of upstream-side rollers which are maintained in contact with each other.

3. The ink-jet recording apparatus according to claim 2, wherein one of the pair of upstream-side rollers is biased against an outer of the pair of upstream-side rollers, such that when the recording sheet is nipped by the pair of upstream-side rollers, said one upstream-side roller is moved away from said other upstream-side roller by a distance equal to a thickness of the recording sheet.

4. The ink-jet recording apparatus according to claim 1, wherein the control device controls said at least one rotating device to rotate, in the backward direction, the pair of downstream-side rollers to feed the trailing end of the recording sheet to said range and subsequently stop the rotation of the pair of downstream-side rollers in the backward direction so as to stop, for the second predetermined time duration, the trailing end at a position within said range and before the nip position.

5. The ink-jet recording apparatus according to claim 1, wherein the control device controls said at least one rotating device to continuously rotate, in the backward direction, the pair of downstream-side rollers to feed the trailing end of the recording sheet to said range and continuously feed the trailing end to the nip position.

6. The ink-jet recording apparatus according to claim 1, wherein the radius of said one of the pair of upstream-side rollers is not less than 1 mm.

7. The ink-jet recording apparatus according to claim 1, wherein the first predetermined time duration starts when the recording of the first image on said one surface of the recording sheet ends.

8. The ink-jet recording apparatus according to claim 1, further comprising a position detector which detects a current position of the trailing end of the recording sheet along the sheet-feed path.

9. The ink-jet recording apparatus according to claim 1, wherein the control device determines, based on at least one of (a) a material of the recording sheet and (b) an amount of the droplets of ink ejected onto a predetermined portion of the recording sheet that is located in a vicinity of the trailing end thereof, at least one feeding speed at which the trailing end of the recording sheet is fed from a position of the trailing end at a time when the recording of the first image on said one surface of the recording sheets ends, to said range.

10. The ink-jet recording apparatus according to claim 1, wherein the control device controls said at least one rotating device to rotate, in the backward direction, the pair of downstream-side rollers to feed, at a first feeding speed, the trailing end of the recording sheet from a position of the trailing end at a time when the recording of the first image on said one surface of the recording sheet ends, to a position distant from said range in the downstream direction by a predetermined distance, and to feed, at a second feeding speed lower than the first feeding speed, the recording sheet when the trailing end thereof enters the said range.

11. The ink-jet recording apparatus according to claim 1, wherein the control device controls said at least one rotating device to rotate, in the backward direction, the pair of downstream-side rollers to feed the trailing end of the recording sheet to the nip position and, in a state in which the trailing end is positioned at the nip position, the control device controls said at least one rotating device to stop the rotation of the pair of downstream-side rollers in the backward direction for the second predetermined time duration.

12. The ink-jet recording apparatus according to claim 1, wherein the control device controls said at least one rotating device to rotate, when the trailing end of the recording sheet enters said range, the pair of downstream-side rollers in the backward direction at a speed lower than a speed at which the recording sheet is fed in the downstream direction when the first image is recorded on said one surface of the recording sheet.

13. The ink-jet recording apparatus according to claim 11, wherein after the control device controls said at least one rotating device to stop the rotation of the pair of downstream-side rollers in the backward direction for the second predetermined time duration, the control device controls said at least one rotating device to rotate, in the backward direction, the pair of upstream-side rollers to feed the trailing end of the recording sheet from the nip position to the sheet reversing device.

14. The ink-jet recording apparatus according to claim 1, wherein the control device controls said at least one rotating device to continuously rotate, in the backward direction, the pair of downstream-side rollers and the pair of upstream-side rollers to feed the trailing end of the recording sheet from a position of the trailing end at a time when the recording of the first image on said one surface of the recording sheet ends, to the nip position, and continuously rotate, in the backward direction, the pair of downstream-side rollers and the pair of upstream-side rollers to feed the trailing end of the recording sheet from the nip position to the sheet reversing device.

15. The ink-jet recording apparatus according to claim 1, wherein the recording head is provided above the sheet-feed path and which records the first image on an upper surface of the recording sheet, and wherein the apparatus further comprises a platen which is provided below the recording head via the sheet-feed path and which supports a lower surface of the recording sheet.

16. The ink-jet recording apparatus according to claim 1, wherein the sheet reversing device reverses the recording sheet upside down such that the trailing end thereof is changed to a leading end of the reversed recording sheet, and feeds the leading end of the reversed recording sheet to the pair of upstream-side rollers.

17. The ink-jet recording apparatus according to claim 1, further comprising a sheet-discharge tray which receives the recording sheet having the first image recorded on said one surface thereof and additionally having the second image recorded on said other surface thereof, wherein the pair of downstream-side rollers comprise a pair of sheet-discharge rollers which cooperate with each other to discharge the recording sheet to the sheet-discharge tray.

18. The ink-jet recording apparatus according to claim 1, wherein said at least one rotating device comprises a common rotating device which rotates the pair of downstream-side rollers in synchronism with the rotation of the pair of upstream-side rollers.

19. The ink-jet recording apparatus according to claim 1, wherein the pair of upstream-side rollers include a first drive roller which is rotated by said at least one rotating device, and a first follower roller which is biased toward the first drive roller and cooperates with the first drive roller to nip the recording sheet and which, when the first drive roller is rotated, is rotated with the first drive roller to feed the recording sheet, and wherein the pair of downstream-side rollers include a second drive roller which is rotated by said at least one rotating device, and a second follower roller which is biased toward the second drive roller and cooperates with the second drive roller to nip the recording sheet and which, when the second drive roller is rotated, is rotated with the second drive roller to feed the recording sheet.

20. The ink-jet recording apparatus according to claim 1, wherein as soon as the recording of the first image on said one surface of the recording sheet ends, the control device controls said at least one rotating device to start rotating the pair of downstream-side rollers in the backward direction so as to feed the recording sheet in the upstream direction.

21. An ink-jet recording apparatus, comprising:

an ink-jet recording head which ejects droplets of ink toward one of opposite surfaces of a recording sheet so as to record a first image on said one surface;

a pair of upstream-side rollers which are provided on an upstream side of the recording head with respect to a sheet-feed path and which are rotated to feed the recording sheet to the recording head in a downstream direction along the sheet-feed path;

a pair of downstream-side rollers which are provided on a downstream side of the recording head with respect to the sheet-feed path and which are rotated to feed the recording sheet from the recording head in the downstream direction along the sheet-feed path;

at least one rotating device which rotates, in a forward direction corresponding to the downstream direction, the pair of upstream-side rollers and the pair of downstream-side rollers, and rotates, in a backward direction corresponding to an upstream direction opposite to the downstream direction, at least the pair of downstream-side rollers;

a sheet reversing device which reverses, on an opposite side of the pair of upstream-side rollers that is opposite to the recording head, the recording sheet having the first image on said one surface thereof, and which feeds the reversed recording sheet to the pair of upstream-side rollers so that the pair of upstream-side rollers feed the reversed recording sheet to the recording head again so as to record a second image on an other of the opposite surfaces of the reversed recording sheet; and a control device, wherein when the recording head records the first image on said one surface of the recording sheet, the control device controls said at least one rotating device to rotate, in the forward direction, the pair of upstream-side rollers and the pair of downstream-side rollers such that a trailing end of the recording sheet is fed to a position outside a radius range between (a) a nip position where the pair of upstream-side rollers nip the recording sheet and (b) a downstream-side position that is distant from the nip position in the downstream direction by a distance equal to a radius of one of the pair of upstream-side rollers that is located on one side of the sheet-feed path on which side the recording head is provided, wherein the control device controls said at least one rotating device to rotate, in the backward direction, the pair of downstream-side rollers to feed the recording sheet in the upstream direction along the sheet-feed path such that the trailing end of the recording sheet enters said range within a predetermined time duration, wherein when the recording sheet is fed in the upstream direction, the control device controls said at least one rotating device to rotate, in the backward direction, the pair of downstream-side rollers to feed, at a first feeding speed, the recording sheet in the upstream direction along the sheet-feed path from a position of the trailing end at a time when the recording of the first image on said one surface of the recording sheet ends, to a position distant from said range in the downstream direction by a predetermined distance, and to feed, at a second feeding speed which is less than the first feeding speed, the recording sheet when the trailing end thereof enters said range.

22. The ink-jet recording apparatus according to claim 1, wherein when the recording sheet is fed in the upstream direction toward the nip position, the control device controls said at least one rotating device to decrease the speed of rotation of the pair of downstream-side rollers in the backward direction and thereby stop the rotation of the pair of downstream-side rollers such that the trailing end is stopped at a position within said range for the second predetermined time duration.

* * * * *